United States Patent [19]

Kohler

[11] 4,163,423

[45] Aug. 7, 1979

[54] PROXIMITY FUZE

[75] Inventor: Hans W. Kohler, Washington, D.C.

[73] Assignee: The United States of America as represented by the Secretary of the Army, Washington, D.C.

[21] Appl. No.: 189,250

[22] Filed: Apr. 18, 1962

[51] Int. Cl.[2] ..... F42C 13/00

[52] U.S. Cl. ..... 102/211

[58] Field of Search ..... 102/70.2 P, 18, 19.2, 102/211-214; 310/5, 6; 73/503

[56] References Cited

U.S. PATENT DOCUMENTS

| | | | |
|---|---|---|---|
| 2,505,042 | 4/1950 | Gourdon | 102/211 |
| 2,514,359 | 7/1950 | Allison | 102/212 |
| 2,974,588 | 3/1961 | Fogal et al. | 102/19.2 |
| 2,983,149 | 5/1961 | Lees | 73/503 |
| 2,998,775 | 9/1961 | Craft | 102/211 |

FOREIGN PATENT DOCUMENTS

| | | | |
|---|---|---|---|
| 91592 | 2/1938 | Sweden | 102/211 |

*Primary Examiner*—Charles T. Jordan

*Attorney, Agent, or Firm*—Nathan Edelberg; Robert P. Gibson; Saul Elbaum

EXEMPLARY CLAIM

4. In a projectile comprising a casing having a first electrically conducting part, a second electrically conducting part and an electrically insulating part interposed between said first and second conducting part, a proximity detector comprising:

(a) a bridge circuit;

(b) said bridge circuit having a first terminal connected to said first electrically conducting part of said projectile casing; and (c) said bridge circuit having a second terminal adjacent to said first terminal and connected to said second electrically conducting part of said projectile casing.

11 Claims, 4 Drawing Figures

PROXIMITY FUZE

The invention described herein may be manufactured and used by or for the Government of the United States of America for governmental purposes without the payment to me of any royalty thereon.

This invention relates to influence fuzes and more particularly to capacitance type proximity detectors.

The larger military munitions, bombs, artillery and mortar shells, missiles and rockets, generally rely on proximity type fuzes for causing detonations having maximum destructive effect. Most of the proximity fuzes presently in use are of the type requiring a self-contained signal transmitting unit. Such proximity detectors (active fuzes) transmit an electrical signal, receive reflections of these signals from some nearby object, and compare some characteristic of the transmitted and received signals in order to obtain information as to the proximity of the device to the reflecting surface. Since these devices require transmitting, receiving and comparing circuits, they are relatively complex. Miniaturization of components through use of solid state active devices and other techniques has reduced the size of such mechanisms, but the number of components needed continues to adversely affect their cost and reliability.

It is therefore an object of this invention to provide a proximity detection device of great simplicity.

It is a further object of this invention to provide means for detecting changes in capacitance in an electric field caused by the entering of a body or surface into this field.

These and other objects are achieved by providing within a munition a Wheatstone bridge having two capacitance arms. One of these capacitances is a standard, fixed-value capacitor, and the other is comprised of two conducting portions of the munition surface, which act as the capacitor plates, and the insulating material between these portions, which acts as the capacitor dielectric.

It is well known that the capacitance between two isolated conducting bodies is determined by the electric field configuration between these two bodies, and this field configuration is affected by the geometry and the electrical properties of any material within the field. In order to maximize the distance from the fuze to the body whose proximity we wish to detect (range sensitivity) the electric field of the fuze should fringe or bulge out into space away from the munition. This is obtained by separating the two electrodes constituting the exposed part of the fuze as much as possible, one of the electrodes being located at or near the tip of the munition as it approaches the target.

It should be noted that the capacitor constituting the sensing element of the fuze, described above as having two electrodes may in practice have more than two electrodes. One or both of the electrodes of the basic capacitance fuze may be split into several parts connected electrically in parallel, these parts being for example distributed around the axis of symmetry of the munition (e.g. the longitudinal axis) to obtain target sensing in any aximuthal direction.

In the present invention, the capacitance between the sensing electrodes of the fuze forms one arm of a Wheatstone bridge that is balanced when the munition is located in "free space". In practice, free space conditions are satisfactorily approximated when the munition is several times its largest linear dimension away from other bodies.

Approach of munition and target changes the field configuration of the fuze and thus the capacitance in one arm of the bridge circuit. The bridge becomes unbalanced and produces a voltage signal that is used to detonate the warhead.

The fuze under discussion radiates, at most, very little electromagnetic energy since it operates at andio frequencies or low radio frequencies and relies for its action on the quasistationary electric field. The fuze, being essentially non-radiating, is highly immune to conventional electronic countermeasures and uses very little power. Accordingly, its radius of action is rather limited, being on the order of the largest dimension of the munition that holds the fuze.

Thus, the principal field of application of this fuze is as a quasi-contact fuze. In this case detonation of the warhead takes place prior to the actual contact between munition and target, before deformation due to impact. The fuze also works prior to contacting soft targets such as snow-covered ground. Mechanical contact fuzes, for example, may not be activated in deep soft snow until the munition is deeply buried and the fragmenting warhead thus more or less contained.

The specific nature of the invention, as well as other objects, uses and advantages thereof, will clearly appear from the following description and from the accompanying drawing, in which.

Figure 1A:
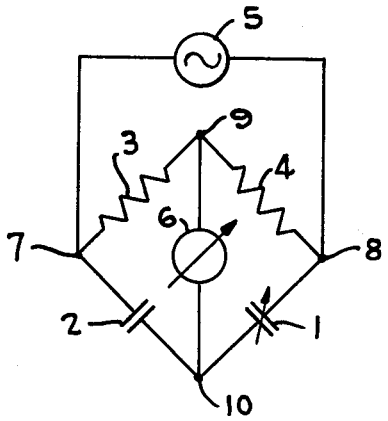
FIG. 1A is a schematic diagram of a bridge circuit used in the present invention.

Referring first to FIG. 1A, there is shown a schematic diagram of a Wheatstone bridge having two adjacent capacitance arms 1 and 2 and two adjacent resistance arms 3 and 4. A source of power, oscillator 5, is provided across one opposing pair of bridge terminals, 7 and 8, and a voltage detector 6 is provided across the other pair of opposing terminals 9 and 10. Denoting the impedances of arms 1, 2, 3 and 4 as $Z_1$, $Z_2$, $Z_3$ and $Z_4$, respectively, the voltage appearing across terminals 9 and 10 maybe represented by $$V = E\left(\frac{Z_1}{Z_1 + Z_2} - \frac{Z_3}{Z_3 + Z_4}\right) \tag{1}$$

where E is the magnitude of the voltage across terminals 7 and 8 and the Z's are impedances having, in general, resistive and reactive components. From this equation it may be seen that the voltage across the detector 6 will be zero when $$\frac{Z_1}{Z_1 + Z_2} = \frac{Z_3}{Z_3 + Z_4} \text{ or } \frac{Z_1}{Z_2} = \frac{Z_3}{Z_4} \tag{2}$$

in which condition the bridge is said to be in balance. In FIG. 1A, let $Z_1=(1/jwC_1)$, $Z_2=(1/jwC_2)$, $Z_3=R_1$, and $Z_4=R_2$.

The values of the various circuit parameters may be chosen so that $|Z_1|=|Z_2|=|Z_3|=|Z_4|$ when the bridge is in balance, this being the condition for greatest bridge sensitivity to small changes in the impedance of one arm. When the bridge is so designed, $C_1 = C_2$ for the balanced condition. If the value of $C_1$ is then changed, the bridge becomes unbalanced and a voltage, the magnitude of which is determined by equation (1), appears across detector 6. Of course, in the bridge circuit of FIG. 1A, the generator 5 and detector 6 could be interchanged in accordance with well known engineering practice without changing the theory of operation of the circuit. It is understood that detector 6 in the various figures generally includes an amplifier, since the signal due to the unbalance of the bridge is relatively small.

Figure 1B:
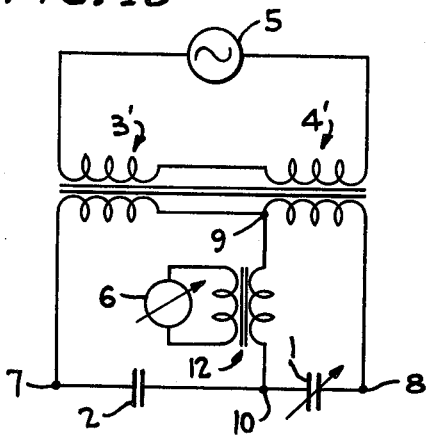
FIG. 1B is a schematic diagram of a second form of bridge circuit used in the present invention.

FIG. 1B represents a modification of the bridge circuit of FIG. 1A wherein transformers 3' and 4' replace the resistors 3 and 4 of FIG. 1A. These transformers also serve as a means for coupling the output of generator 5 across the input terminals 7 and 8 of the bridge of FIG. 1B. A transformer 12 has its primary connected across terminals 9 and 10 of the bridge and its secondary connected to detector 6, so that the voltage across detector 6 is an indication of the voltage difference appearing across terminal 9 and 10 when the bridge is unbalanced.

Figure 2:
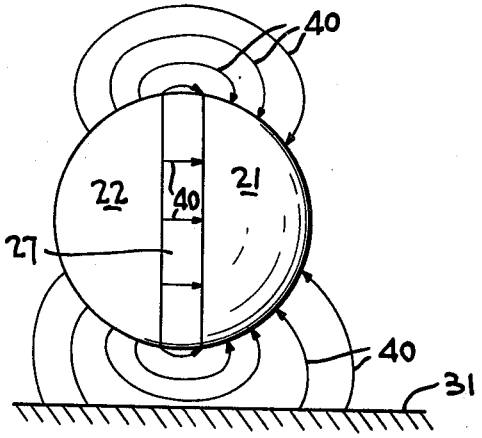
FIG. 2 is a pictorial drawing illustrating the principle of operation of this invention.

Turning now to FIG. 2, there is shown a pictorial representation of a spherical munition in proximity to a large body 31. The shell of the munition is comprised of two metal hemispheres 21 and 22 and an electrically insulating band 27 interposed between them. If an electric potential were applied across the hemispheres 21 and 22, they would behave as the plates of a capacitor. The lines of electric force 40 would pass through the insulating material 27 and would "bulge out" into the air surrounding the munition. When the sphere comes close to the target body 31, the body will come within the fringe field of the capacitor.

The capacity between the surrounding electrodes is increased over that in free space whether the target body be a conductor, a dielectric or any combination of these, as exemplified in such diverse targets as tanks, soldiers, woods, ground or water.

Figure 3:
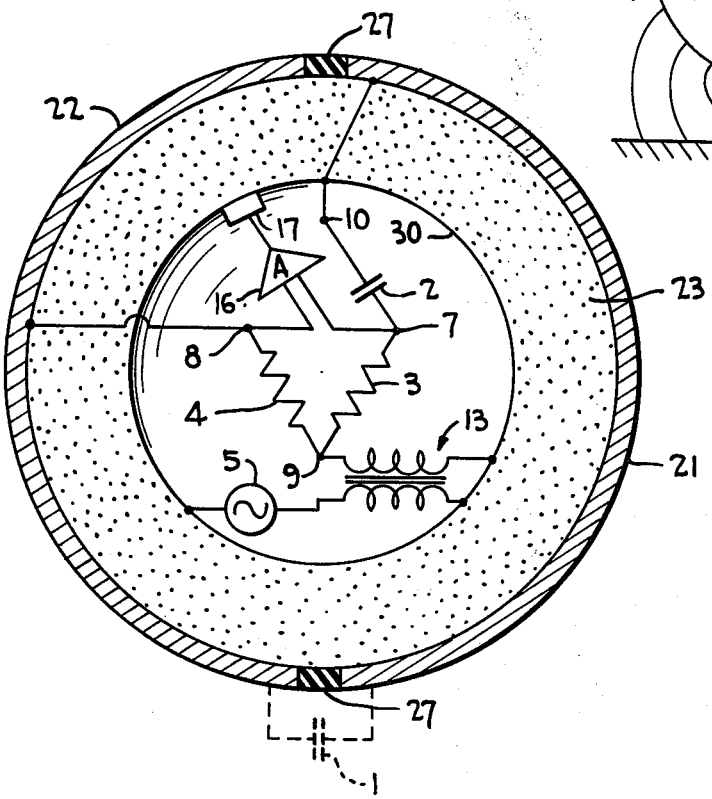
FIG. 3 is partly schematic and partly cross-sectional view of a preferred embodiment of this invention.

FIG. 3 illustrates, partly in cross section and partly in schematic form, a spherical munition utilizing a bridge circuit according to the present invention. The munition shown in FIG. 3 comprises two conducting hemispheres 21 and 22 separated from each other by a circumferential, electrically insulating strip 27. An explosive charge 23 is disposed between the hemispheres 21 and 22 and a conducting sphere 30. Although, for purposes of illustration, the sphere 30 is shown in FIG. 3 to be relatively large, in practice it could be quite small; it need only be large enough to hold the bridge circuit, generator 5, amplifier 16 and detonator 17. The proximity detector used in the device of FIG. 3 comprises a bridge circuit composed of equal resistors 3 and 4 and capacitor 2, all of which are disposed within conducting sphere 30. The fourth arm of the bridge is connected to bridge terminals 8 and 10 and comprises the hemispheres 21 and 22. The capacitance of this arm is determined by the dielectric constant of both the insulating band 27 and the material present in the fringe field between the two hemispheres 21 and 22. An exciting voltage for the bridge circuit is provided by AC voltage generator 5 connected in series with the primary winding of transformer 13. The other side of the primary of transformer 13 is connected to the other side of generator 5 through conducting sphere 30. The secondary winding of transformer 13 is connected between terminal 9 of the bridge circuit and the conducting sphere 30, and the terminal 10 of the bridge circuit is also connected to conducting sphere 30, so that the voltage across the secondary of terminal 13 is applied across opposite terminals of the bridge circuit. A detecting amplifier 16 is provided across the other pair of opposing bridge circuit terminals 7 and 8. The output of this amplifier is connected to an electrically excited detonating device 17, which, in turn, will set off charge 23. The amplifier 16 may be of any well known type capable of producing a signal of sufficient amplitude to activate detonator 17, and the detonator 17 may be any suitable, well-known, electrically activated type.

The bridge circuit is initially adjusted so that the capacitance of capacitor 2 will equal the capacitance between hemisphere 21 and 22 when the munition is in free space; e.g., when the munition is so isolated that no external object will affect the capacitance between hemispheres 21 and 22. The bridge is then said to be balanced for the free-space condition. When the munition approaches the ground or some large solid object, the capacitance between hemispheres 21 and 22 will increase (for reasons explained in connection with FIG. 2), thus causing the bridge to unbalance and a voltage to appear between terminals 7 and 8. When this voltage difference becomes large enough, the output of amplifier 16 will be sufficient to initiate detonator 17, which in turn will set off the explosive 23.

It should be noted that the sensing capacitor of the present invention is excited by an AC source which gives it certain operating advantages over a similar sensing capacitor excited by a DC source. This is true because the plates of a capacitor excited by a DC source tend to lose some of their charge to the atmosphere under certain weather conditions, notably under conditions of high humidity. Since the capacitor of the present invention is being recharged during each cycle of the energizing means, this difficulty is eliminated.

Many modifications of the devices illustrated in the drawings would obviously be within the spirit and teaching of this invention. For example, the fuze of the present invention could be incorporated in any type of munition, such as an artillary shell or missile. In such application, the plates of the sensing capacitor could be derived from the nose and body of the projectile, which plates could be separated from each other by a circular insulating band. Another possible modification could be the use of any other known type of AC bridge circuit, such as that shown in FIG. 1B.

It will be apparent that the embodiment shown is only exemplary and that various modifications can be made in construction and arrangement within the scope of the invention as defined in the appended claims.

1. A proximity detector comprising:

(a) a projectile having a first outer surface portion and a second outer surface portion, said portions comprising electrically conducting material covering substantially all of said projectile;

(b) a body of electrically non-conducting material disposed between said first and second portions of said projectile, and serving to separate said first and second portions from each other; and (c) a Wheatstone bridge disposed within said projectile and connected so that said first and second portions of said projectile comprise the plates of a capacitor in one arm of said bridge circuit.

2. A proximity detector as recited in claim 1 wherein said projectile is of the spherical type.

3. A proximity detector as recited in claim 1 wherein said projectile is of the cylindrical type.

4. In a projectile comprising a casing having a first electrically conducting part, a second electrically conducting part and an electrically insulating part interposed between said first and second conducting part, a proximity detector comprising:

(a) a bridge circuit;

(b) said bridge circuit having a first terminal connected to said first electrically conducting part of said projectile casing; and (c) said bridge circuit having a second terminal adjacent to said first terminal and connected to said second electrically conducting part of said projectile casing.

5. A device as recited in claim 4 wherein said bridge circuit is of the Wheatstone type.

6. A device as recited in claim 5 wherein said bridge further comprises:

(a) a third terminal and a fourth terminal; and (b) a fixed capacitor connected between said second terminal and said third terminal.

7. A device as recited in claim 6 wherein said bridge circuit further comprises:

(a) a first fixed resistor connected between said third terminal and said fourth terminal; and (b) a second fixed resistor connected between said fourth terminal and said first terminal.

8. A device as recited in claim 7 wherein said first and second fixed resistors have equal resistance values.

9. A device as recited in claim 7 wherein said bridge circuit further comprises:

(a) a source of electrical power connected between said first and third terminals; and (b) a voltage detector connected between said second and fourth terminals.

10. A device as recited in claim 9 wherein said generator is of the alternating current type.

11. A device as recited in claim 10 wherein the capacitance appearing across said first and second terminals is equal to the capacitance appearing across said second and third terminals when said device is isolated in space.

* * * * *